US005287785A

United States Patent [19]

Miller

[11] Patent Number: 5,287,785

[45] Date of Patent: Feb. 22, 1994

[54] MUSICAL BRASS INSTRUMENT SLIDE APPARATUS

[76] Inventor: Robert P. Miller, 143 Buckingham Cir., Charlottesville, Va. 22903

[21] Appl. No.: 12,765

[22] Filed: Feb. 3, 1993

[51] Int. Cl.[5] ..... G10D 9/04

[52] U.S. Cl. ..... 84/391; 84/395; 446/206; 446/209

[58] Field of Search ..... 84/387 R, 391, 393, 84/395; 446/206, 209

[56] References Cited

U.S. PATENT DOCUMENTS

| | | | |
|---|---|---|---|
| 3,909,779 | 9/1975 | McCracken | 84/395 |
| 3,937,116 | 2/1976 | Ramirez | 84/395 |
| 3,973,464 | 8/1976 | Novy | 84/392 |

*Primary Examiner*—Michael L. Gellner

*Assistant Examiner*—Patrick J. Stanzione

*Attorney, Agent, or Firm*—Leon Gilden

[57] ABSTRACT

A slide housing having a plurality of rows of side wall ports directed into the side walls of the housing is arranged to receive a slide block within the housing, wherein the slide block includes through-extending bores arranged for alignment with the side wall bores, with a helical wind tube mounted to the side walls, with the wind tube having individual coils, and each coil including a coil exit port, and the coil exit ports are mounted to the side wall ports, with the slide arranged to effect intercommunication between a selected number of the individual coils to effect pitched change in use of the instrument. The slide block includes a slide conduit received within an instrument bell conduit in pneumatic communication with the instrument bell.

4 Claims, 4 Drawing Sheets

MUSICAL BRASS INSTRUMENT SLIDE APPARATUS

BACKGROUND OF THE INVENTION

1. Field of the Invention

The field of invention relates to the use of brass instrument slide arrangements and particularly pertains to a new and improved musical brass instrument slide apparatus wherein the same is arranged to effect pitch change in brass instruments employing a slide mounted within a housing arranged to effect selective pneumatic communication of individual coils of a helical wind tube mounted in communication with a housing.

2. Description of the Prior Art

Wind instruments, and particularly brass instruments, use various slide arrangements such as exemplified in the U.S. Pat. Nos. 4,860,629; 4,831,911; 3,903,779; 3,631,755; and 3,937,116.

The instant invention attempts to overcome deficiencies of the prior art by providing for ease of pitch change in use of a brass instrument by having a helically wound coil permitting selective cooperation between an individual or plurality of the coils to effect pitch change in directing pneumatic communication between a mouth piece tube and a bell conduit of the instrument.

SUMMARY OF THE INVENTION

In view of the foregoing disadvantages inherent in the known types of instrument apparatus now present in the prior art, the present invention provides a musical brass instrument slide apparatus wherein the same is arranged to permit ease of pitch change within a musical brass instrument by pneumatically associating individual coils of a helically wound wind tube. As such, the general purpose of the present invention, which will be described subsequently in greater detail, is to provide a new and improved musical brass instrument slide apparatus which has all the advantages of the prior art musical instrument slide and valve structure and none of the disadvantages.

To attain this, the present invention provides a slide housing having a plurality of rows of side wall ports directed into the side walls of the housing arranged to receive a slide block within the housing, wherein the slide block includes through-extending bores arranged for alignment with the side wall bores, with a helical wind tube mounted to the side walls, with the wind tube having individual coils, and each coil including a coil exit port, and the coil exit ports are mounted to the side wall ports, with the slide arranged to effect intercommunication between a selected number of the individual coils to effect pitched change in use of the instrument. The slide block includes a slide conduit received within an instrument bell conduit in pneumatic communication with the instrument bell.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved musical brass instrument slide apparatus which has all the advantages of the prior art instrument apparatus and none of the disadvantages.

It is another object of the present invention to provide a new and improved musical brass instrument slide apparatus which may be easily and efficiently manufactured and marketed.

It is a further object of the present invention to provide a new and improved musical brass instrument slide apparatus which is of a durable and reliable construction.

An even further object of the present invention is to provide a new and improved musical brass instrument slide apparatus which is susceptible of a low cost of manufacture with regard to both materials and labor, and which accordingly is then susceptible of low prices of sale to the consuming public, thereby making such musical brass instrument slide apparatus economically available to the buying public.

Still yet another object of the present invention is to provide a new and improved musical bras instrument slide apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
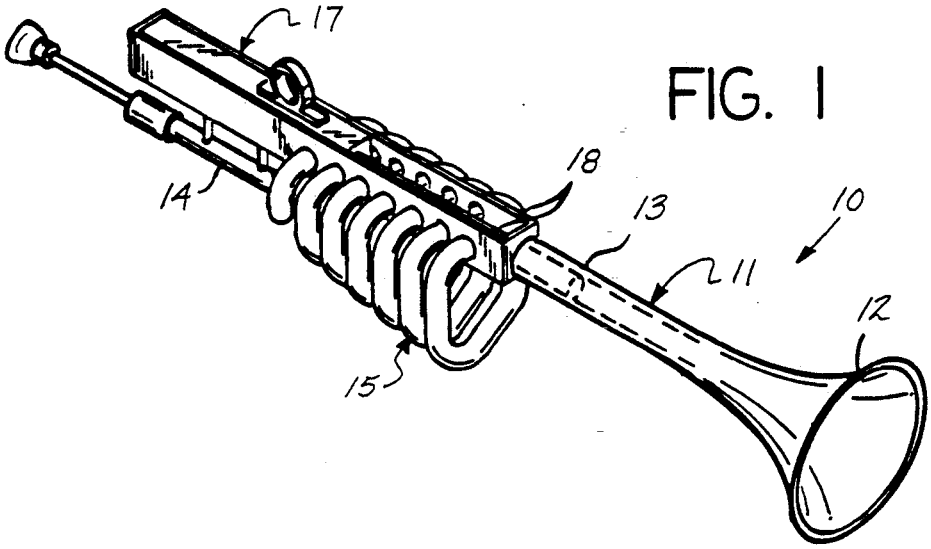
FIG. 1 is an isometric illustration of the invention.
Figure 2:
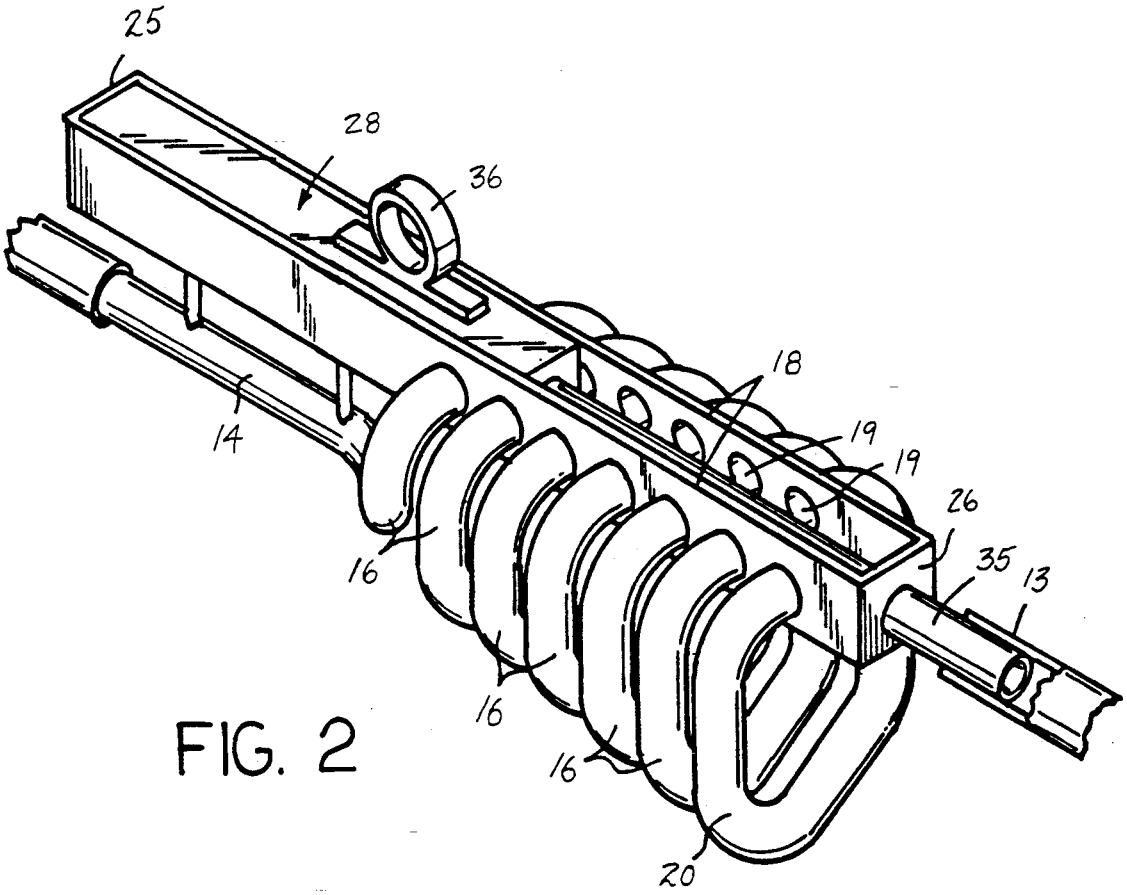
FIG. 2 is an enlarged isometric illustration of the slide structure of the invention.
Figure 3:
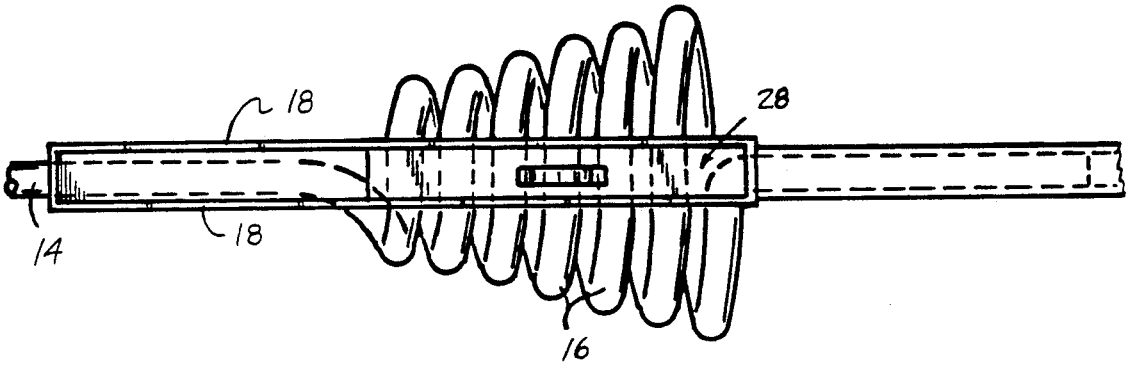
FIG. 3 is an orthographic top view of the slide structure.
Figure 4:
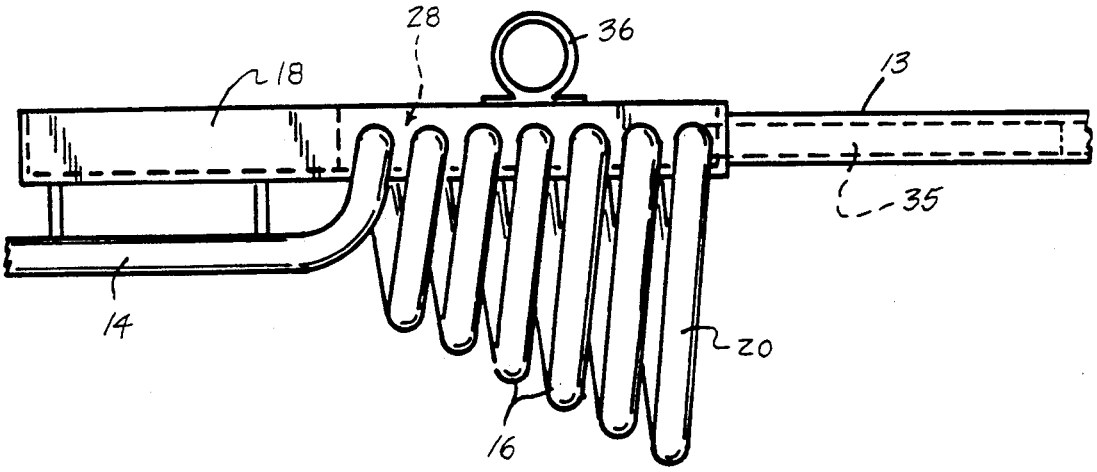
FIG. 4 is an orthographic side view of the slide structure.
Figure 5:
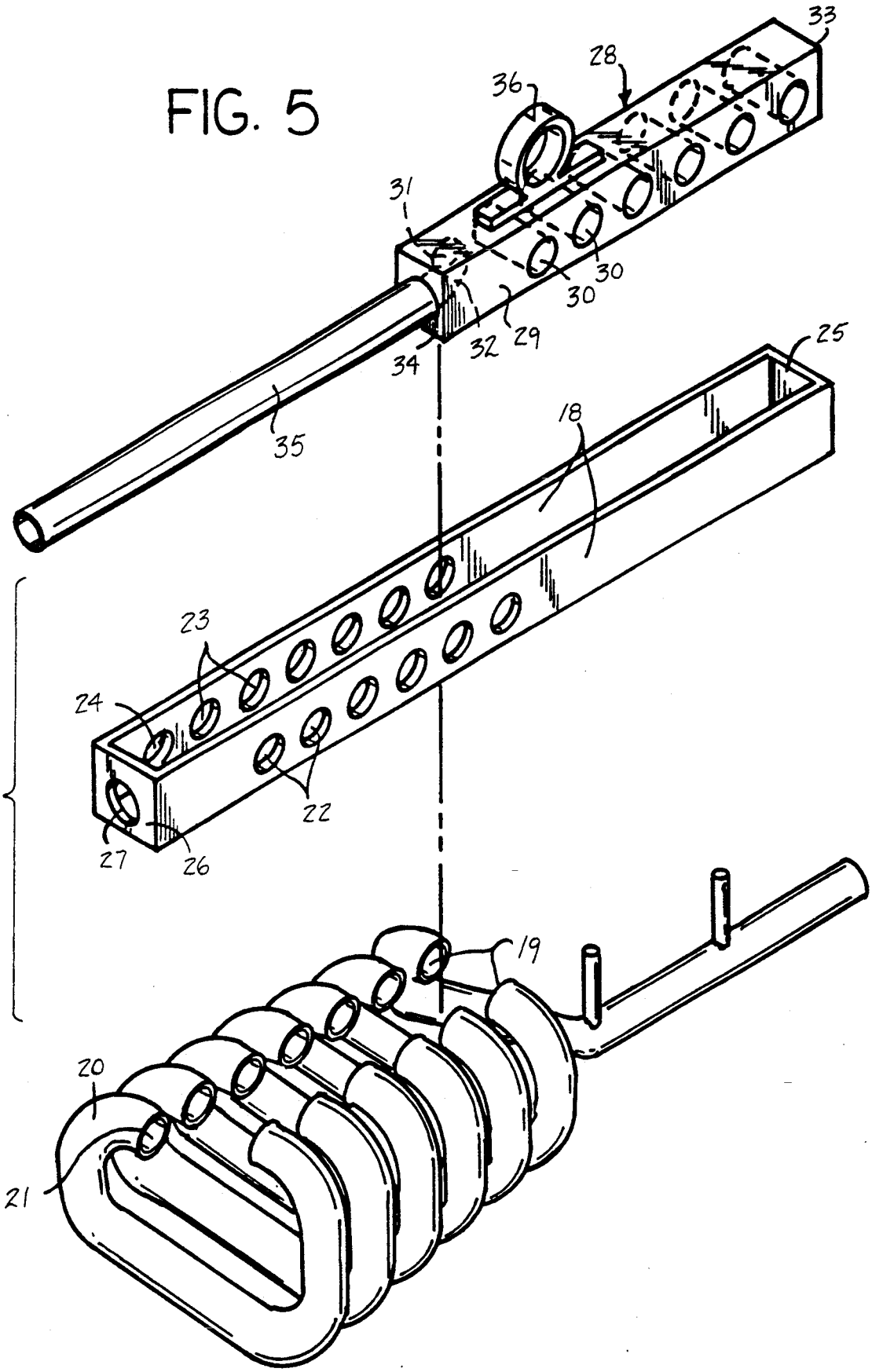
FIG. 5 is an isometric exploded view of the slide structure.
Figure 6:
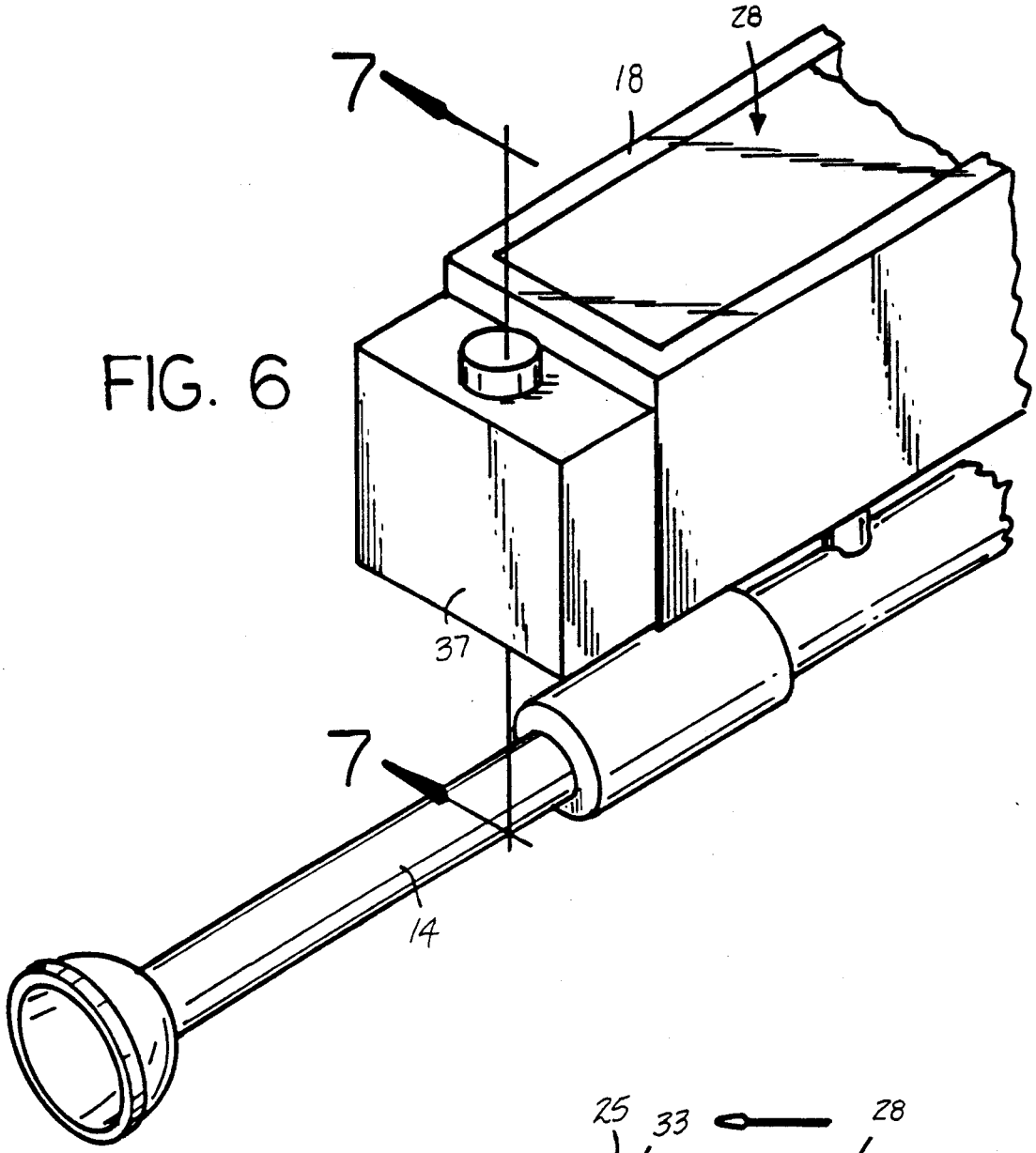
FIG. 6 is an isometric rear view of a modified housing structure.

With reference now to the drawings, and in particular to FIGS. 1 to 7 thereof, a new and improved musical brass instrument slide apparatus embodying the principles and concepts of the present invention and generally designated by the reference numeral 10 will be described.

More specifically, the musical brass instrument slide apparatus 10 of the instant invention essentially comprises mounting to an associated musical brass instrument 11, having an instrument bell 12 to include a bell conduit 13 in pneumatic communication with the bell 12. A mouthpiece tube 14 is provided in pneumatic communication with an instrument mouthpiece, with a helically wound wind tube 15 having coils of increasing diameter arranged in pneumatic communication with the mouthpiece tube 14 at a first end of the wind tube 15, and in pneumatic communication with the instrument bell conduit 13 through a slide housing 17 and slide block 28.

The slide housing 17 includes spaced side walls 18 arranged in a coextensive parallel relationship relative to one another. The helical wind tube 15 has its individual wind tube coil 16 terminating in a predetermined number of ports to include spaced pairs of coaxially aligned coil ports 19 equal to a predetermined number of pairs, with an end coil 20 of the wind tube 15 oriented in adjacency relative to the housing second end wall 26, with an end coil port 21 (see FIG. 5). Each of the pairs of coil ports 19 are mounted to respective first and second rows of side wall ports 22 and 23 respectively, wherein one of the first side wall ports 22 is oriented in coaxial alignment with a second side wall port 23, and each of such side wall port pairs to include one of the first ports 22 and one of the second ports 23 total said predetermined number of pairs, with a second row additional port 24 receiving the end coil port 21. A slide block 28 is slidably received within the housing between the housing first and second end walls 25 and 26 and the housing side walls 18, with the housing having a housing second end wall opening 27 receiving a slide block slide conduit 35 fixedly and orthogonally mounted to the slide block second end wall 34 spaced from the slide block first end wall 33. The slide block slide conduit 35 is directed into the slide block terminating in a slide block second bore 31 arranged for alignment with the housing second end row additional port 24 when the slide block second end wall 34 is in contiguous communication with the housing second end wall 26. A plurality of spaced parallel first bores 30 of the slide block 28 are orthogonally directed through side walls of the slide block, and are arranged to permit selective alignment of the first bores 30 with individual or all of the pairs of first and second ports 22 and 23. A slide conduit 35 maintains pneumatic communication of one or all of the coils 16 and 20 with the instrument bell conduit 13. A handle 36 is mounted to the slide block top wall for ease of manipulation of the slide block relative to the housing.

Figure 7:
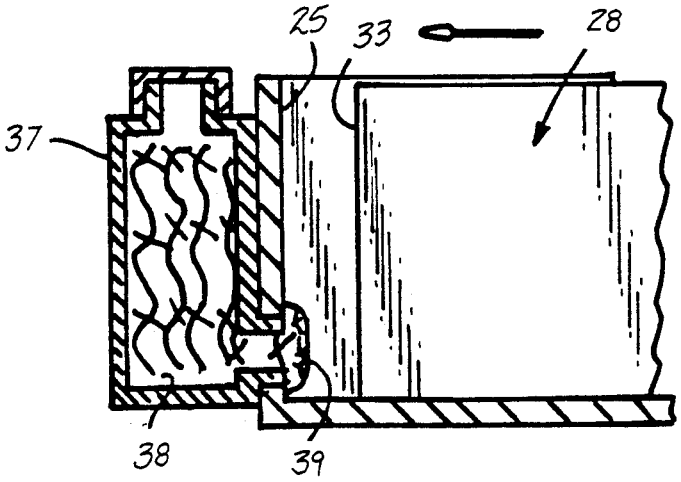
FIG. 7 is an orthographic view, taken along the lines 7—7 of FIG. 6 in the direction indicated by the arrows.

The FIG. 7 includes a reservoir housing 37 mounted to the housing first end wall 25, with the reservoir housing including a housing link cavity 38 containing a lubricant therewithin, typically of a dry powder type that is dispersed through a fibrous wick 39 to maintain lubrication of the slide block relative to the housing in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A musical brass instrument slide apparatus mounted within a brass instrument, having an instrument bell and a bell conduit, with the instrument further having a mouthpiece tube, and valve means for effecting pneumatic and selective communication between the mouthpiece tube and the bell conduit, with the valve means having a slide housing, the slide housing arranged in fixed communication to the mouthpiece tube, and the slide housing including spaced parallel housing side walls and a housing first end wall spaced from a housing second end wall, and a wind tube in pneumatic communication with the mouthpiece tube, and the wind tube having a plurality of individual tube coils, with the tube coils extending along the slide housing, with the slide housing having spaced pairs of coaxially aligned coil ports defining a predetermined number of pairs of coil ports, with the wind tube coils including an end coil in pneumatic communication with the individual wind tube coils through the valve means and with the end coil directed into one of said housing side walls terminating in an end coil port directed into the slide housing adjacent the housing second end wall, wherein the housing side walls include a first row of side wall ports directed into one of the housing side walls, and a second row of side wall ports directed into a further of said housing side walls, wherein the first row of side wall ports defining first ports and the second row of side wall ports defining second ports, wherein one of said first ports is aligned with one of said second ports to define a housing port pair, and the housing port pairs equal said predetermined number.

2. An apparatus as set forth in claim 1 including a slide block slidably received within the housing between the first side wall and the second side wall and the first end wall and the second end wall, with the slide block having a slide block first end wall parallel to the housing first end wall, and the slide block having a second end wall parallel to the housing second end wall, and the slide block having slide block side walls arranged in adjacency to the housing side walls, with the slide block side walls including a plurality of first bores, and a second bore parallel to the first bores, with the second bore arranged in adjacency to the slide block second end wall, wherein the first bores and the second bore equals said predetermined number, with the first bores and the second bore arranged for selective alignment with the housing port pairs.

3. An apparatus as set forth in claim 2 wherein the slide block includes a slide block slide conduit directed through the slide block second end wall in pneumatic communication with the second bore, and the slide conduit slidably positioned within the bell conduit.

4. An apparatus as set forth in claim 3 including a reservoir housing mounted to the housing first end wall, with the reservoir housing having a reservoir cavity, and a fibrous wick directed through the reservoir housing in communication with the reservoir housing, with a fibrous wick projecting into the slide housing through the slide housing first end wall, with the reservoir cavity including a lubricant therewithin, and the lubricant directed into the slide housing through the slide housing first end wall through the wick.

* * * * *